US007297861B2

(12) United States Patent
Sunako

(10) Patent No.: US 7,297,861 B2
(45) Date of Patent: Nov. 20, 2007

(54) AUTOMATIC PERFORMANCE APPARATUS AND METHOD, AND PROGRAM THEREFOR

(75) Inventor: Motonori Sunako, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 380 days.

(21) Appl. No.: 10/870,312

(22) Filed: Jun. 16, 2004

(65) Prior Publication Data

US 2004/0267791 A1 Dec. 30, 2004

(30) Foreign Application Priority Data

Jun. 26, 2003 (JP) ..... 2003-182196

(51) Int. Cl.
*G10H 7/00* (2006.01)
*G10H 1/06* (2006.01)

(52) U.S. Cl. ..... 84/622; 84/600

(58) Field of Classification Search ..... 84/622, 84/737, 600, 604, 653; 707/100
See application file for complete search history.

(56) References Cited

U.S. PATENT DOCUMENTS 4,915,007 A * 4/1990 Wachi et al. ..... 84/622
5,160,799 A * 11/1992 Tozuka et al. ..... 84/653
5,340,940 A * 8/1994 Iizuka et al. ..... 84/622
6,184,453 B1 * 2/2001 Izumisawa ..... 84/604
2001/0037722 A1 * 11/2001 Shimizu et al. ..... 84/622
2002/0023530 A1 * 2/2002 Komano et al. ..... 84/622
2003/0172799 A1 9/2003 Sakurai
2005/0061141 A1 * 3/2005 Yamauchi ..... 84/600

* cited by examiner

*Primary Examiner*—Don Wong
*Assistant Examiner*—Hung Tran Vy
(74) *Attorney, Agent, or Firm*—Morrison & Foerster LLP

(57) ABSTRACT

Performance data include at least a particular type of control parameter, like velocity data. Tones colors include ones of a first type for which the particular type of control parameter presents a first variation characteristic, and ones of a second type for which the control parameter presents a second variation characteristic. Environment setting data can be either set via a user's apparatus or received from another apparatus, and the environment setting data may include tone-color-change instructing information. When an automatic performance is to be executed on the basis of the performance data, a tone color of the performance data to be automatically performed is changed into a tone color corresponding to the instructing information. Tone color change instruction by the instructing information is invalidated, when the tone color be changed between tone colors of the first and second types.

9 Claims, 4 Drawing Sheets

AUTOMATIC PERFORMANCE APPARATUS AND METHOD, AND PROGRAM THEREFOR

BACKGROUND OF THE INVENTION

The present invention relates to automatic performance apparatus and computer programs for automatically performing music pieces with desired tone colors on the basis of predetermined automatic performance data. For example, the present invention relates to an automatic performance apparatus and computer program which, when a change is to be made between tone colors of different characteristics in accordance with a tone color change instruction given from another automatic performance apparatus, can avoid musical failure or nonconformity that may be caused in tones automatically performed with a new or changed-to tone color.

So far, there have been known various automatic performance apparatus which execute automatic performances by generating tones of appropriate tone colors on the basis of automatic performance data of desired music pieces. According to a typical conventional tone-color setting/changing scheme used in relation to automatic performance data of the MIDI format, program change data are incorporated into the performance data, in correspondence with tone-color setting or changing positions in a performance sequence, and tone colors are set or changed in accordance with the program change data.

Another type of automatic performance apparatus has also been known, which can previously store performance environments, often called "registration", that comprises, for example, settings about tone colors and tone volumes for a manual performance by a user and settings about an accompaniment to be automatically performed in accordance with the manual performance and which can communicate, via an external storage medium, communication interface or the like, the thus-set performance environments or registration to an external other electronic musical instrument (automatic performance apparatus) etc. The settings about the automatic performance include one that instructs a change of a tone color to be used in the accompaniment performance. Namely, the conventionally-known automatic performance apparatus can not only execute an automatic performance of an accompaniment or the like in accordance with automatic performance data while merely changing part of a performance environment, such as a tone color, but also execute an automatic performance utilizing performance environments acquired from an external other electronic musical instrument or the like.

SUMMARY OF THE INVENTION

New technique for setting a tone color for an automatic performance is disclosed in Japanese Patent Application No. 2002-066486 that has not yet been laid open to the public at the time of the initial filing in Japan of the present invention. In this yet-to-be-laid-open patent application, there is proposed a tone generation apparatus that is equipped with special-type tone colors having different characteristics from ordinary-type tone colors, such as rendition-style-dependent tone colors corresponding to different rendition styles for a specific type of musical instrument like a steel guitar, electric bass guitar or the like. Unlike in the ordinary-type tone colors, different tone colors (rendition-style-dependent tone colors) are mapped in both a velocity direction and a note-number direction per mapping of a special-type tone color, so that a tone color change can be effected using the velocity and note number instead of using, for example, a program change in the performance data. Using such a special-type tone color scheme permits quicker tone color changes during an automatic performance, with the result that an automatic performance can be executed with a variety of tone colors through simple control.

Way of using the velocity and note number differs between the special-type tone color and the ordinary-type tone colors as noted above. Thus, in order to permit use of the special-type tone color in the automatic performance apparatus, it is necessary to prepare and incorporate automatic performance data for the special-type tone color, separate from automatic performance data for the ordinary-type tone colors, in conformity with such a different way of using the velocity and note number. Regarding the incorporated automatic performance data for the special-type tone color, a tone color change may be instructed on the basis environment setting data (also called "registration data") acquired from another automatic performance apparatus. However, if, for example, environment setting data (registration data), including an instruction for changing a special-type tone color of a performance part to an ordinary-type tone color, is applied to a given performance part that is using a special-type tone color, then the automatic performance data of the given performance part, which are prepared in advance solely for the special-type tone color, will not all match the changed-to ordinary-type tone color. Namely, merely applying such environment setting data (registration data), including an instruction for changing a special-type tone color of a performance part to an ordinary-type tone color, to the given performance part using the special-type tone color may cause musical failure or nonconformity in tones performed on the basis of the performance data of the given performance part. Similar inconvenience may occur in a case where environment setting data (registration data), including an instruction for changing an ordinary-type tone color to a special-type tone color, is applied to a given performance part that is using an ordinary-type tone color.

In view of the foregoing, it is an object of the present invention to provide an improved automatic performance apparatus and program which, in an application where performance data based on a special tone-color setting or designating format, different from an ordinary tone-color setting or designating format, are used, can reliably avoid musical failure or nonconformity in tones performed when a tone color change is instructed,. More specifically, the present invention seeks to provide an automatic performance apparatus and program which, in an application where a change is instructed between special- and ordinary-type tone colors of different characteristics, for example, in accordance with tone-color-change instructing information acquired from another automatic performance apparatus or in accordance with tone-color-change instructing information based on a user instruction or the like, can reliably avoid musical nonconformity in tones performed on the basis of performance data, by not reflecting such an instructed tone color change in the performance.

In order to accomplish the above-mentioned object, the present invention provides an improved automatic performance apparatus, which comprises: a performance data storage device storing performance data, the performance data including at least a particular type of control parameter and information indicative of a tone color, the tone color being of either a first type for which the particular type of control parameter presents a first variation characteristic or a second type for which the particular type of control parameter presents a second variation characteristic different from the first variation characteristic; a reception section that receives tone-color-change instructing information; and a performance control device that executes an automatic performance on the basis of the performance data stored in the performance data storage device, the performance control device executing the automatic performance based on the performance data by changing the tone color of the performance data to be automatically performed into a tone color corresponding to the tone-color-change instructing information received by the reception section. In this invention, the performance control device invalidates a tone color change instruction by the received tone-color-change instructing information, when the received tone-color-change instructing information instructs that the tone color of the performance data to be automatically performed be changed from a tone color of the first type to a tone color of the second type or from a tone color of the second type to a tone color of the first type.

In the case where the variation characteristic presented by the particular type of control parameter differs between tone colors of the first and second types, and when a tone color change is made from a tone color of the first type to a tone of the second type or vice versa, the particular type of control parameter in the performance data will have a greatly different meaning on the tone color changed from the original tone color (i.e., changed-to tone color), which is very likely to cause significant musical failure or nonconformity in the automatic performance. Thus, the present invention is arranged to invalidate a tone color change instruction by the tone-color-change instructing information when the information instructs that the tone color of the performance data be changed from a tone color of the first type to a tone color of the second type or from a tone color of the second type to a tone color of the first type, with the result that the present invention can reliably avoid musical failure or nonconformity in the automatic performance.

In an embodiment to be later described, the particular type of control parameter is velocity data. For the tone color of the first type, the velocity data indicates a velocity of a tone color for which only a single domain of values can be taken by the velocity data, while, for the tone color of the second type, the domain of values that can be taken by the velocity data is divided into a plurality of ranges and the velocity data represents a different tone color for each of the ranges and indicates a velocity of the different tone color.

The different tone colors for the individual ranges in the tone color of the second type belong to a same tone color of a predetermined type and present different tone color characteristics corresponding to different rendition styles The present invention may be constructed and implemented not only as the apparatus invention as discussed above but also as a method invention. Also, the present invention may be arranged and implemented as a software program for execution by a processor such as a computer or DSP, as well as a storage medium storing such a software program. Further, the processor used in the present invention may comprise a dedicated processor with dedicated logic built in hardware, not to mention a computer or other general-purpose type processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which.

DETAILED DESCRIPTION OF THE EMBODIMENTS

Figure 1:
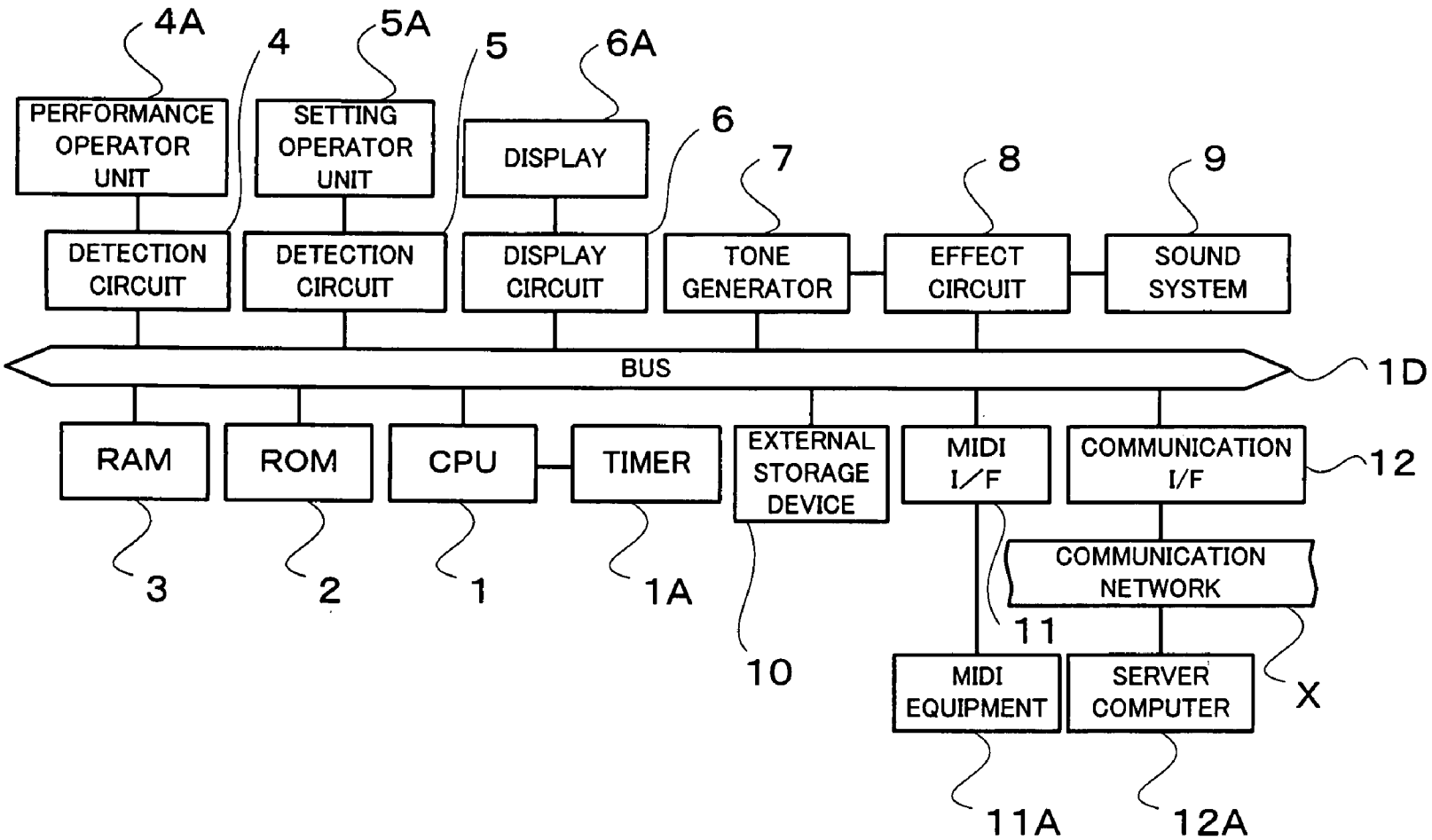
FIG. 1 is a block diagram illustrating a general hardware setup of an electronic musical instrument to which is applied an automatic performance apparatus in accordance with an embodiment of the present invention.

FIG. 1 is a block diagram illustrating a general hardware setup of an electronic musical instrument, to which is applied an automatic performance apparatus in accordance with an embodiment of the present invention. This electronic musical instrument is controlled by a microcomputer comprising a microprocessor unit (CPU) 1, a read-only memory (ROM) 2 and a random-access memory (RAM) 3. The CPU 1 controls behavior of the entire electronic musical instrument. To the CPU 1 are connected, via a data and address bus 1D, the ROM 2, RAM 3, detection circuits 4 and 5, display circuit 6, tone generator (T.G.) circuit 7, effect circuit 8, external storage device 10, MIDI interface (I/F) 11 and communication interface 12. Also connected to the CPU 1 is a timer 1A for counting various time periods and intervals, for example, to signal interrupt timing for a timer interrupt process. For example, the timer 1A generates clock pulses, which are given to the CPU 1 as processing timing instructions or as interrupt instructions. The CPU 1 carries out various processes in accordance with such instructions.

The ROM 2 has prestored therein various programs to be executed by the CPU 1 and various data. The RAM 3 is used as a working memory for temporarily storing various data generated as the CPU 1 executes a predetermined program, as a memory for storing the currently-executed program and data related thereto, and for various other purposes. Predetermined address regions of the RAM 3 are allocated and used as registers, flags, tables, memories, etc. Performance operator unit 4A is, for example, a keyboard including a plurality of keys for designating pitches of tones and key switches corresponding to the keys. The performance operator unit 4A, such as a keyboard, can be used not only for a manual performance by a user, but also as an input means for entering automatic performance environments etc. into the apparatus. The detection circuit 4 is a performance operation detection means for detecting depression and release of the keys on the performance operator unit 4A to thereby produce performance detection outputs.

Setting operator unit 5A includes various switches and operators for inputting various information pertaining to an automatic performance. Specifically, the setting operator unit 5A includes a touch pad, jog shuttle and other operators operable by the user to select a music piece to be actually manually performed and enter various information pertaining to an automatic performance, such as accompaniment style data to be used for an accompaniment performance. In addition to the above-mentioned switches and operators, the setting operator unit 5A may include a numeric keypad for entry of numeric value data and a keyboard for entry of text and character data which are to be used for selecting, setting and controlling a tone pitch, tone color, effect, etc., and various other operators, such as a mouse for operating a predetermined pointing element displayed on the display device 6A that may be in the form of an LCD (Liquid Crystal Display) and/or CRT (Cathode Ray Tube). The detection circuit 5 constantly detects respective operational states of the individual operators on the setting operator unit 5A and outputs switch information, corresponding to the detected operational states of the operators, to the CPU 1 via the data and address bus 1D. The display circuit 6 visually displays not only performance environments currently set on the display device 6A, but also various information pertaining to an automatic performance, such as memory-stored accompaniment style data, a controlling state of the CPU 1, etc. The user can, for example, select, enter and set various information pertaining to performance environments with reference to the various information displayed on the display device 6A.

The tone generator (T.G.) circuit 7, which is capable of simultaneously generating tone signals in a plurality of channels, receives, via the data and address bus 1D, various performance information generated in response to user's manipulation on the performance operator unit 4A or on the basis of accompaniment style data, and it generates tone signals based on the received performance information. Each of the tone signals thus generated by the tone generator circuit 7 is audibly reproduced or sounded by a sound system 9, including an amplifier and speaker, after being imparted with en effect via the effect circuit 8. The effect circuit 8 includes a plurality of effect units which impart various effects to the tone signals, generated by the tone generator circuit 7, in accordance with effect parameters. The tone generator circuit 7, effect circuit 8 and sound system 9 may be constructed in any conventionally known manner. For example, any desired known tone signal synthesis method may be used in the tone generator circuit 7, such as the FM, PCM, physical model or formant synthesis method. Further, the tone generator circuit 7 may be implemented by either dedicated hardware or software processing performed by the CPU 1.

The external storage device 10 is provided for storing various data, such as accompaniment style data, environment setting data and waveform data, as well as control-related data and various control programs executed by the CPU 1. The external storage device 10 may includes a waveform memory (waveform ROM) for storing a plurality of sets of waveform data corresponding to ordinary- and special-type tone colors. Where a particular control program is not prestored in the ROM 2, the control program may be prestored in the external storage device (e.g., hard disk device) 10, so that, by reading the control program from the external storage device 10 into the RAM 3, the CPU 1 is allowed to operate in exactly the same way as in the case where the particular control program is stored in the ROM 2. This arrangement greatly facilitates version upgrade of the control program, addition of a new control program, etc. The external storage device 10 may comprise any of various removable-type media other than the hard disk (HD), such as a flexible disk (FD), compact disk (CD-ROM or CD-RAM), magneto-optical disk (MO) and digital versatile disk (DVD). The external storage device 10 may comprise a semiconductor memory, such as a flash memory.

The MIDI interface (I/F) 11 is an interface provided for receiving or delivering automatic performance data of the MIDI format (i.e., MIDI data) from or to other MIDI equipment 11A or the like externally connected to the electronic musical instrument. Note that the other MIDI equipment 11A may be of any structural or operating type, such as the keyboard type, stringed instrument type, wind instrument type, percussion instrument type or body-attached type, as long as it can generate MIDI data in response to manipulations by the user. Also note that the MIDI interface 11 may be a general-purpose interface rather than a dedicated MIDI interface, such as RS-232C, USB (Universal Serial Bus) or IEEE1394, in which case other data than MIDI event data may be communicated at the same time. In the case where such a general-purpose interface as noted above is used as the MIDI interface 11, the other MIDI equipment 11A may be designed to be able to communicate other data than MIDI event data. Of course, the automatic performance data handled in the present invention may be of any other data format than the MIDI format, in which case the MIDI interface 11 and other MIDI equipment 11A are constructed in conformity to the data format used.

The communication interface 12 is connected to a wired or wireless communication network X, such as a LAN (Local Area Network), the Internet or telephone line network, via which it may be connected to a desired sever computer 12A so as to input a control program and various data to the electronic musical instrument from the sever computer 12A. Thus, in a situation where a particular control program and various data are not contained in the ROM 2 or external storage device (e.g., hard disk) 10, these control program and data can be downloaded from the server computer 12A via the communication interface 12. Such a communication interface 12 may be constructed to be capable of both wired and wireless communication rather than either one of the wired and wireless communication.

Further, in the above-described electronic musical instrument, the performance operator unit 4A may be of any other type than the keyboard instrument type, such as a stringed instrument type, wind instrument type or percussion instrument type. Furthermore, the electronic musical instrument is not limited to the type where the performance operator unit 4A, display device 6A, tone generator circuit 7, etc. are incorporated together as a unit within the musical instrument; for example, the electronic musical instrument may be constructed in such a manner that the above-mentioned sections are provided separately and interconnected via communication facilities such as a MIDI interface, various networks and/or the like. Moreover, the automatic performance apparatus of the present invention may be applied to any desired type of equipment other than electronic musical instrument, such as a personal computer, portable (hand-held) phone or other portable communication terminal, karaoke apparatus or game apparatus. In the case where the automatic performance apparatus of the present invention is applied to a portable communication terminal, the predetermined functions may be performed as a whole system, comprising the terminal and a server, by causing the server to perform part of the functions, rather than causing only the terminal performing all of the predetermined functions.

Now, a description will be given about a plurality of special-type tone colors prestored in the tone generator circuit 7, ROM 2, external storage device 10 or the like, which have different characteristics from ordinary-type tone colors that can be designated by bank select data and program change data included in automatic performance data. In the instant embodiment, for each musical instrument playable with various different rendition styles, sets of waveform data, corresponding to a plurality of rendition-style-dependent tone colors of the special-type tone color, are stored in association with various values of velocity data and note number data. Such a feature will be described below in relation to an instrument tone color of a steel guitar.

Figure 2A:
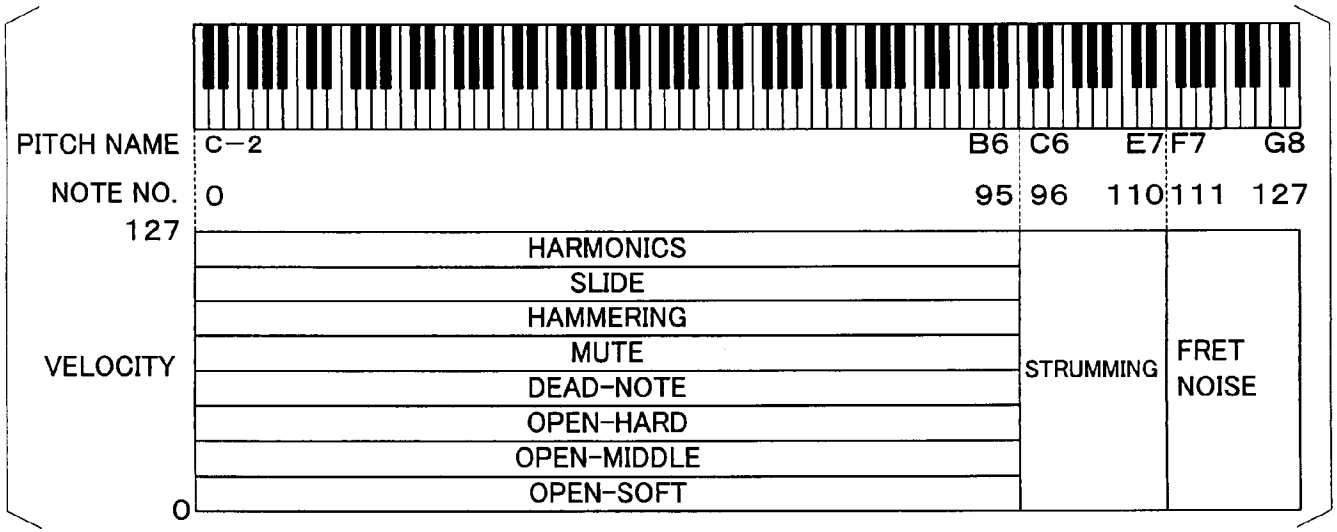
FIG. 2A is a conceptual diagram showing exemplary tone color-volume mapping of a special-type tone color, which particularly shows allocation, to pitch names, of rendition-style-dependent tone colors of the special-type tone color.
Figure 2B:
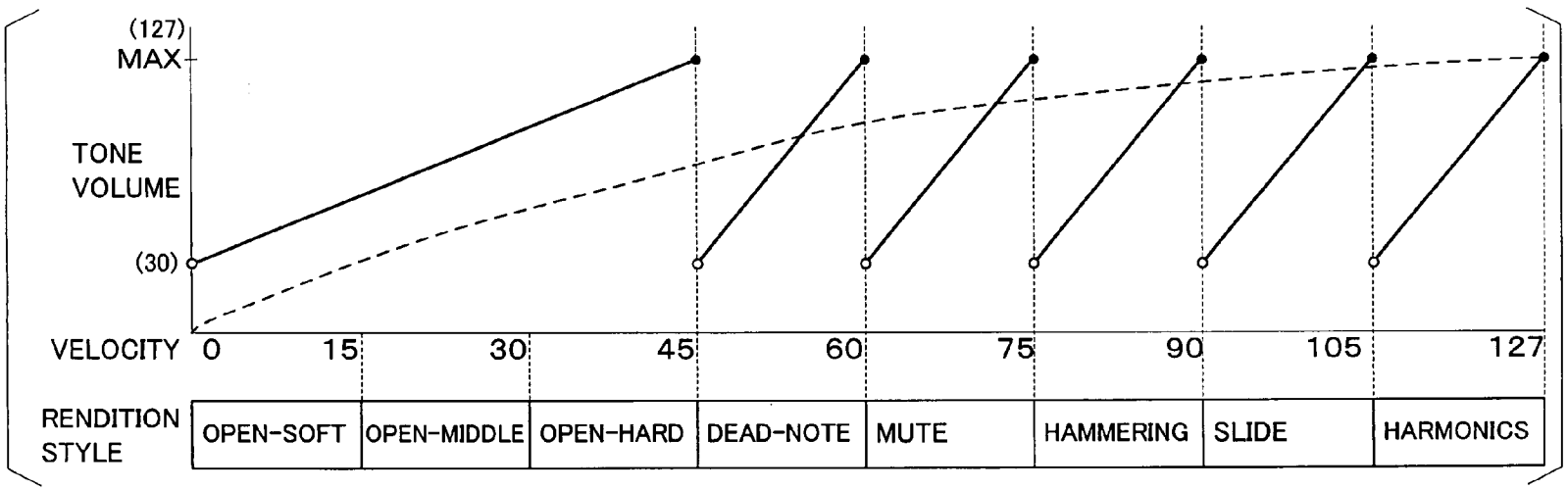
FIG. 2B is a diagram showing allocation, to velocities, of the rendition-style-dependent tone colors.

FIG. 2 conceptually shows an example of tone color-tone volume mapping for a special-type tone color (rendition-style-dependent tone colors). More specifically, FIG. 2A is a diagram showing allocation, to pitch names (note numbers), of the rendition-style-dependent tone colors belonging to the steel guitar tone color, and FIG. 2B is a diagram showing allocation, to velocities, of the rendition-style-dependent tone colors belonging to the steel guitar tone color. Note that the velocity data normally represents a larger volume of a tone signal as its value increases; in the instant embodiment, the velocity data value varies within a range of "0" to "127", note that the velocity data value "0" has the same meaning as a "note-off" value. The note number data normally represents a higher pitch (higher-pitch name) of a tone signal as its value increases; in the instant embodiment, the note number data value varies within a range of "0" to "127". Here, the note number data value "0" corresponds to a pitch name "C-2", and the note number data value "127" corresponds to a pitch name "G8".

In the case of the steel guitar, eight types of rendition-style-dependent tone colors: "open-soft rendition style tone color"; "open-middle rendition style tone color"; "open-hard rendition style tone color"; "dead-note rendition style tone color"; "mute rendition style tone color"; "hammering rendition style tone color"; "slide rendition style tone color"; and "harmonics rendition style tone color", are allocated over a pitch range of C-2-B6 that correspond to note numbers "0"-"95", as illustratively shown in FIG. 2A. Further, these eight rendition-style-dependent tone colors are allocated to different value ranges of the velocity data. More specifically, as illustrated in FIG. 2B, the open-soft rendition style tone color is allocated to the velocity data value range of "1"-"15", the open-middle rendition style tone color allocated to the velocity data value range of "16"-"30", the open-hard rendition style tone color allocated to the velocity data value range of "31"-"45", the dead-note rendition style tone color allocated to the velocity data value range of "46"-"60", the mute rendition style tone color allocated to the velocity data value range of "61"-"75", the hammering rendition style tone color allocated to the velocity data value range of "76"-"90", the slide rendition style tone color allocated to the velocity data value range of "91"-"105", and the harmonics rendition style tone color allocated to the velocity data value range of "106"-"127".

Further, as seen in FIG. 2A, other rendition-style-dependent tone colors that do not relate to any specific tone pitch are allocated to a pitch range of C6-G8 (corresponding to note numbers "96"-"127") which is not used by an ordinary steel guitar, i.e. over which the ordinary steel guitar normally can not generate any tone. Namely, strumming rendition style tone colors are allocated to the range of C6-E7 corresponding to note numbers "96"-"110", and, more specifically, the strumming rendition style tone colors include a plurality of different strumming rendition style tone colors that are dependent on differences in stroke speed, position at which the left hand is used to mute, etc. These different strumming rendition style tone colors are allocated to different tone pitches within the C6-E7 range. Fret-noise rendition style tone colors are allocated to the pitch range of F7-G8 (corresponding to note numbers "111"-"127"). More specifically, the fret-noise rendition style tone colors include a plurality of fret-noise rendition style tone colors that correspond to a scratch sound produced by scratching a string with a finger or pick, a sound produced by hitting the body of the guitar, etc. These fret-noise rendition style tone colors are allocated to different tone pitches within the F7-G8 range.

Although a set of waveform data may be provided for each of the eight types of rendition-style-dependent tone colors allocated to the steel guitar pitch range of C-2-B6, a plurality of sets of sub waveform data are provided for each of the eight rendition-style-dependent tone colors in the instant embodiment. For example, one of the sets of sub waveform data is provided per predetermined pitch range, e.g. per half octave. In the instant embodiment, the same sets of sub waveform data are provided for shared use among individual velocity data values; however, different sets of such sub waveform data may be provided for the individual velocity data values, i.e. the sub waveform data may be differentiated among the velocity data values.

Further, in the instant embodiment, one set of waveform data is provided for each of the plurality of types of strumming rendition style tone colors and fret-noise rendition style tone colors allocated to the steel guitar pitch range of C6-G8. These sets of waveform data are also stored in the waveform memory. The same sets of waveform data corresponding to the plurality of types of strumming rendition style tone colors and fret-noise rendition style tone colors are provided for shared use among the individual velocity data values; however, different sets of waveform data may be provided for the individual velocity data values, i.e. the waveform data may be differentiated among the velocity data values.

Namely, for each instrument tone color having rendition-style-dependent tone colors, such as the above-mentioned steel guitar tone color, the velocity data values "1"-"127" are allocated to the pitch range of C-2-B6 as selection information for selecting any desired one of the plurality of types of rendition-style-dependent tone colors. Thus, in the instant embodiment, the velocity data values can not be used for tone volume control directly as they are. On the other hand, a predetermined range of velocity data, including a plurality of different velocity data values, is allocated to each of the types of rendition-style-dependent tone colors as tone volume control information. Therefore, if the velocity data values of the predetermined ranges allocated to the individual types of rendition-style-dependent tone colors (horizontal axis) are converted into tone volume control values (vertical axis) with characteristics as depicted in solid lines of FIG. 2B, then the use of the velocity data can select or designate each individual rendition-style-dependent tone color and control the tone volume thereof. Namely, the special-type tone color will have a characteristic with which a predetermined musical element (tone color or tone volume) varies in an unsuccessive manner in accordance with a particular parameter (velocity data). Broken line in FIG. 2B represents a characteristic of tone volume control for an ordinary-type tone color which utilizes the velocity data value varying within the range of "1"-"127". Namely, the ordinary-type tone color has the characteristic that a predetermined musical element (tone volume) varies in a successive manner in accordance with a particular parameter (velocity data).

More specifically, in the case of the dead-note rendition style tone color of the steel guitar tone color shown in FIG. 2B, velocity data values in the "46"-"60" range are allocated to the rendition style tone color. Thus, if these velocity data values in the "46"-"60" range are converted into tone volume control values (vertical axis of FIG. 2B) that range from a relatively small predetermined value (e.g., about "30") to a relatively great predetermined value (e.g., about "127"), then the volume of a tone signal of the dead-note rendition style tone color can be varied from a relatively small predetermined value to a relatively great predetermined value, although resolution is lowered. In the case of the mute rendition style tone color of the steel guitar tone color, velocity data values in the "61"-"75" range only have to be converted into tone volume control values that range from a relatively small predetermined value (e.g., about "30") to a relatively great predetermined value (e.g., about "127"), similarly to the dead-note rendition style tone color. In a similar manner, the volume of a tone signal of each of the hammering, slide and harmonics rendition style tone colors of the steel guitar tone color can be controlled by conversion through the velocity data values.

Further, in the instant embodiment, the remaining three rendition-style-dependent tone colors, i.e. the open-soft rendition style tone color, open-middle rendition style tone color and open-hard rendition style tone color, are classified according to the intensity with which to play the steel guitar; that is, it may be considered that the classification of these three rendition-style-dependent tone colors is based on a difference in tone volume rather than tone color. These three rendition-style-dependent tone colors are very similar. Therefore, velocity data values in the "1"-"45" range, allocated to the three rendition-style-dependent tone colors, only have to be converted into tone volume control values that range from a relatively small predetermined value (e.g., about "30") to a relatively great predetermined value (e.g., about "127"). Although, in the illustrated example of FIG. 2B, the variation range of the converted tone volume control values (i.e., tone volume control values after the conversion) has been described as being the same for all of the above-mentioned rendition-style-dependent tone colors, the variation range of the converted tone volume control values may be differentiated among the rendition-style-dependent tone colors.

Figure 3:
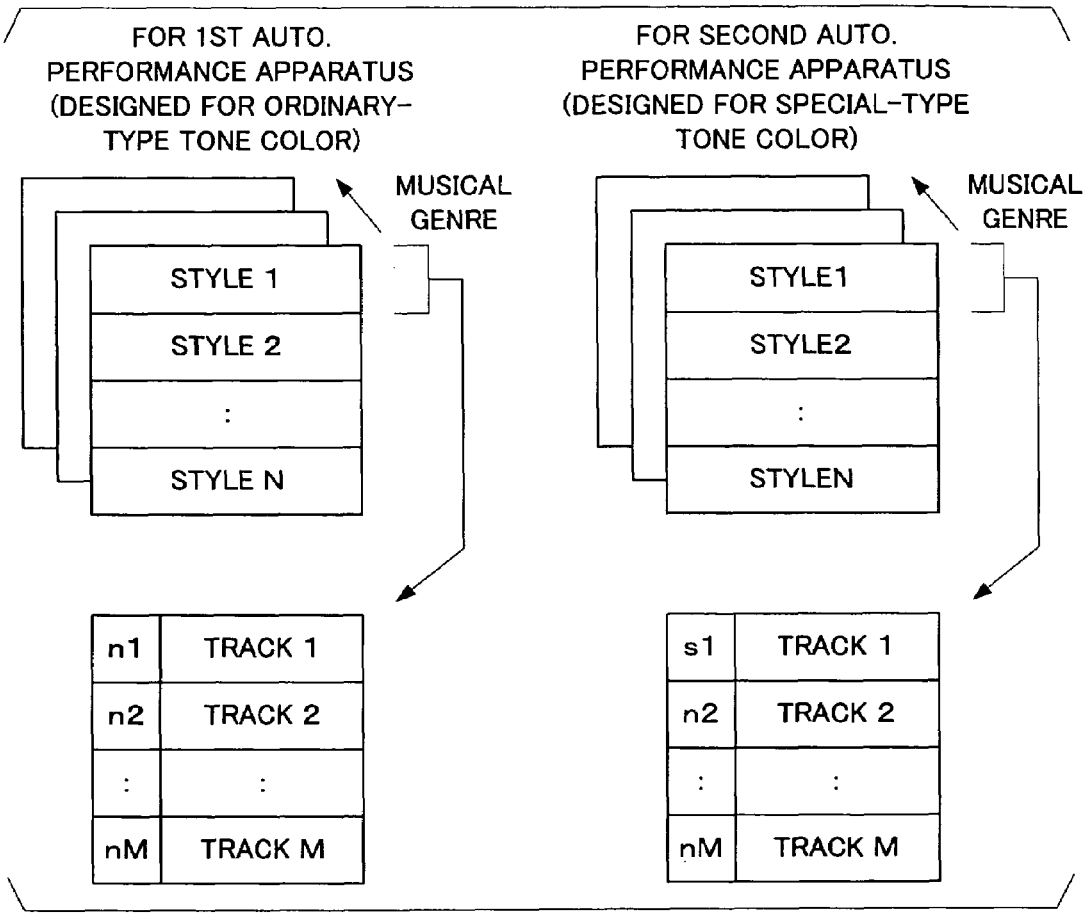
FIG. 3 is a conceptual diagram showing an example organization of accompaniment style data.

This and following paragraphs describe accompaniment style data, one of a plurality of performance environments prestored, for example, in the external storage device 10 so as to be read out or set up for use when an automatic performance is to be executed. FIG. 3 is a conceptual diagram showing an example organization of the accompaniment style data. The accompaniment style data are data defined assuming different performance styles peculiar to musical genres, such as a piano ballad and classical guitar, and the accompaniment style data include a plurality of different types of style data. A plurality of sets of accompaniment style data, Style 1-Style N (N is an arbitrary number, such as "128"), are defined for each musical genre. Each of the sets of accompaniment style data comprises automatic performance data defined for each of a plurality of tracks, Track 1-Track M (M is an arbitrary number, such as "16"), and the automatic performance data of each of the tracks include performance events, tone generation timing data, etc. that form a basis for an actual accompaniment.

Specific default or initially-set tone colors are allocated to the individual tracks of each of the styles (Style 1-Style N), and when the automatic performance data of any one of the tracks are to be reproduced, the specific default or initially-set tone color is used. In FIG. 3, a first automatic performance apparatus of the electronic musical instrument of FIG. 1 is equipped or designed for ordinary-type tone colors alone (not for special-type tone colors), in which ordinary-type tone colors (n1-nM) are allocated, as the default or initially-set tone colors, to the tracks. For these tracks, ordinary automatic performance data are created or provided in such a manner that note numbers correspond directly to tone pitches and velocities correspond directly to tone volumes. Also, in the first automatic performance apparatus, in order to permit a changeover to an appropriate tone color corresponding to a rendition style during execution of an automatic performance, bank select data and program change data, in addition to the performance event data, tone generation timing data, etc., are mixed in the automatic performance data, so that the tone color to be used can be switched or changed in accordance with any of the bank select data and program change data. Namely, respective waveform data sets for the ordinary-type tone colors are stored in different storage regions of the waveform memory in association with the bank select data and program change data and the bank select data and program change data are defined in the automatic performance data in order to select among the different waveform data sets, so that any one of the waveform data sets can be read out for reproduction in accordance with the bank select data and program change data.

Second automatic performance apparatus of FIG. 3, on the other hand, is equipped or designed for special-type tone colors as well as ordinary-type tone colors. In the second automatic performance apparatus, there can be used special-type tone colors, and, in the illustrated example, a special-type tone color is allocated to one of the tracks (represented by "S1" in FIG. 3), for which are provided automatic performance data for the special-type tone color, i.e. automatic performance data having note numbers and velocities defined therein such that a desired tone color and tone volume can be obtained in accordance with the above-mentioned tone color-volume mapping (see FIG. 2). Here, in order to facilitate understanding of the description, the first automatic performance apparatus, designed for ordinary-type tone colors alone (and not for special-type tone colors), and the second automatic performance apparatus, designed for both ordinary-type tone colors and special-type tone colors, will be described in relation to a case where, in both of the first and second automatic performance apparatus, style data sets of same style numbers are directed to identical or similar performance contents. In such a case, similar performance operation is permitted on both of the first and second automatic performance apparatus; namely, on both of the first and second automatic performance apparatus, a similar accompaniment can be provided by user's designation of the same accompaniment style number. However, the second automatic performance apparatus, which is designed for special-type tone colors as well as ordinary-type tone colors, is capable of musical performances of enhanced expressiveness, such as musical performances of higher-degree expression and higher quality.

It should also be appreciated that the present invention is not limited to an electronic musical instrument where the panel operator unit 5, display device 6, tone generator 9, etc. are incorporated together in the same body of the instrument; for example, the basis principles of the present invention may also be applied to an electronic musical instrument where the above-mentioned components are interconnected via communication means, such as an external interface and/or various communication network.

It should also be understood that the automatic performance data to be used in the invention may be in any desired format, such as: the "event plus absolute time" format where the time of occurrence of each performance event is represented by an absolute time within the music piece or a measure thereof, the "event plus relative time" format where the time of occurrence of each performance event is represented by a time length from the immediately preceding event; the "pitch (rest) plus note length" format where each performance data is represented by a pitch and length of a note or a rest and a length of the rest; or the "solid" format where a memory region is reserved for each minimum resolution of a performance and each performance event is stored in one of the memory regions that corresponds to the time of occurrence of the performance event.

Figure 4:
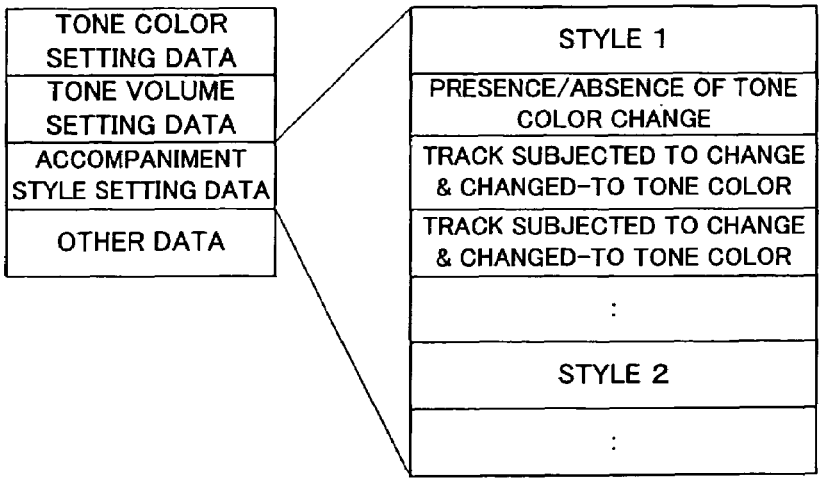
FIG. 4 is a conceptual diagram showing an example organization of environment setting data.

Next, with reference to FIG. 4, a description will be given about environment setting data (i.e., registration data) to be used for setting performance environments, having been set via another electronic musical instrument (automatic performance apparatus), in the electronic musical instrument of FIG. 1 that is to be actually played manually by the user. FIG. 4 is a conceptual diagram showing an example organization of the environment setting data. The environment setting data are data to be used for reproducing, via the electronic musical instrument of the user, performance environments that include settings about tone colors and tone volumes for a manual performance by the user and settings about an accompaniment to be automatically performed to the manual performance, as well as for setting, via an external storage medium or the like, performance environments, having been set by an external other electronic musical instrument, in the electronic musical instrument of the user.

As seen from FIG. 4, the environment setting data are defined by a combination of a multiplicity of pieces of performance setting information, such as tone color setting data and tone volume setting data for a manual performance, accompaniment style setting data for an automatic accompaniment and various other data. Namely, the environment setting data are data which can be used to simultaneously set both performance environments of a manual performance and performance environments of an automatically-performed accompaniment, and which can be communicated between the first and second automatic performance apparatus. The tone color setting data and tone color setting data are data for setting tone colors and tone volumes for a manual performance by the user. The other data include data that designate a beat and tempo to be used for an automatic performance of an accompaniment, etc. The accompaniment style setting data comprise tone-color-change instructing data that instruct a tone color change in an automatically-performed accompaniment, which, for each of all style data sets included in a set of accompaniment style data, include a tone-color-change presence/absence region for recording presence/absence of a tone color change and a track/changed-to color region for recording a track subjected to a tone color change and a changed-to tone color (i.e., tone color after the change). For example, in the case where the accompaniment style data shown in FIG. 3 are defined and when the tone color of Track 1, included in the data of Style 1 of the first automatic performance apparatus, has been switched from the predetermined default or initially-set tone color (n1) to another tone color (n1'), tone-color-change presence/absence information of Style 1 in the accompaniment style setting data is recorded as "change present", "Track 1" is recorded as information indicative of the track having been subjected to the tone color change (track information), and "tone color n1", is recorded as information indicative of the changed-to tone color (i.e., changed-to tone color information). Also, in this case, only "no change present" is recorded as the tone-color-change presence/absence information for the remaining styles (i.e., Style 2-Style N).

In setting performance environments, having been set via another electronic musical instrument, in the electronic musical instrument of FIG. 1 that is to be actually played manually by the user, what matters is the accompaniment style setting data, i.e. data pertaining to a tone color change. For example, when environment setting data are delivered from the first automatic performance apparatus to the second automatic performance apparatus, and if the second automatic performance apparatus changes a special-type tone color of Track 1 (s1) to an ordinary-type tone color (n1), there would inconveniently arise a higher possibility of musical failure or nonconformity in performance contents because the automatic performance data corresponding to the special-type tone color (s1) are stored in Track 1. Thus, the electronic musical instrument, employing the automatic performance apparatus of the present invention, is constructed to avoid such musical nonconformity, through arrangements to be described below, when performance environments for an automatic performance to be executed therein are to be set, in accordance with environment setting data acquired from another electronic musical instrument, to the same performance environments as set by the other electronic musical instrument.

Figure 5:
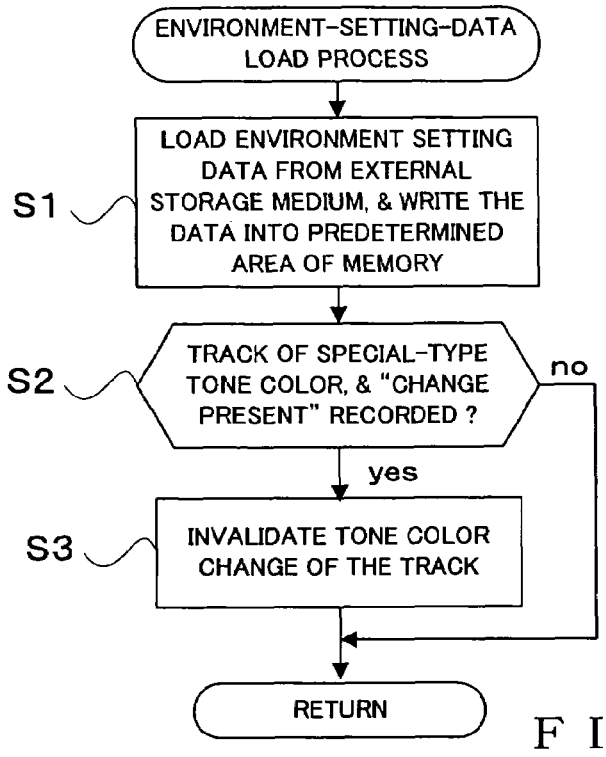
FIG. 5 is a flow chart showing an example operational sequence of an environment-setting-data load process carried out in the embodiment.

Now, a description will be made about a sequence of operations for setting performance environments in the electronic musical instrument of FIG. 1 in accordance with the environment setting data, with reference to FIG. 5. FIG. 5 is a flow chart showing an example operational sequence of an "environment-setting-data load process" carried out in the instant embodiment. Here, the environment-setting-data load process will be described in relation to a case where performance environments similar to those of the first automatic performance apparatus, designed for ordinary-type tone colors alone, is to be set in the second automatic performance apparatus designed for both of ordinary-type and special-type tone colors, using environment setting data generated in the first automatic performance apparatus. Namely, the environment-setting-data load process shown in FIG. 5 is a process executed in the second automatic performance apparatus having acquired the environment setting data from the first automatic performance apparatus equipped for ordinary-type tone colors alone.

At step S1 of FIG. 5, the environment setting data are loaded from an external storage medium and written into a predetermined area of a memory. Namely, once the second automatic performance apparatus receives, from the first automatic performance apparatus, the external storage medium having stored therein the environment setting data generated by the first automatic performance apparatus, it reads out the environment setting data from the external storage medium and writes the read-out data into a memory, such as the RAM 3. At next step S2, it is determined, for each of the styles of the accompaniment style setting data in the environment setting data, whether "change present" is recorded as the tone-color-change presence/absence information and whether the track having been subjected to the tone color change is a track whose original tone color is a special-type tone color. If "change present" is recorded as the tone-color-change presence/absence information and the original tone color of the track is special-type tone color as determined at step S2 (i.e., YES determination at step S2), the tone color change of that track is made invalid at step S3. The operation for invalidating the tone color change is performed by rewriting the corresponding data, included in the accompaniment style setting data of the environment setting data currently stored in the RAM 3, as if there were no tone color change. For example, if the tone color of Track 1 alone included in the data of Style 1 has been changed from a given ordinary-type tone color (n1) to another ordinary-type tone color (n1'), then "change present" (for simplicity of explanation, let it be assumed that no color change has been made to the other tracks), then "Track 1" and "tone color n1" are temporarily recorded, at step S1, in the RAM 3 of the second automatic performance apparatus as the track having been subjected to a tone color change and changed-to tone color, respectively. However, because the tone color of Track 1 included in the data of Style 1 in the second automatic performance apparatus is a special-type tone color (s1), the tone color change recording is made invalid at step S3 above, and data changes are made to the environment setting data, to be stored in the RAM 3 of the second automatic performance apparatus, such that "no change present" is recorded as the tone-color-change presence/absence information of Style 1 and that "Track 1" and "tone color nil", temporarily recorded at step S1 as the track having been subjected to the tone color change and the changed-to tone color, are erased.

Figure 6:
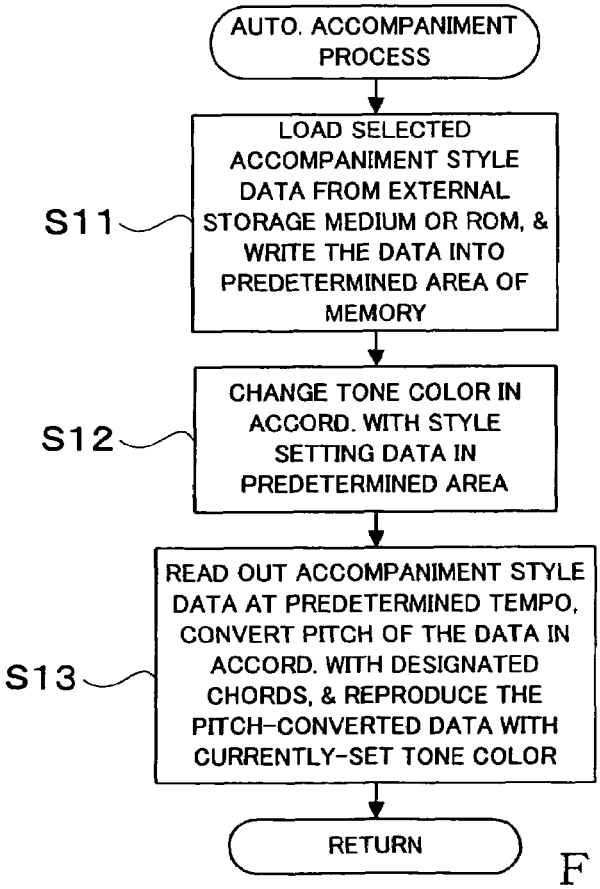
FIG. 6 is a flow chart of an example operational sequence of an automatic accompaniment process carried out in the embodiment.

Next, a description will be given about an "automatic accompaniment process" carried in the instant embodiment for automatically performing an accompaniment via the electronic musical instrument under performance environments corresponding to the environment setting data. FIG. 6 is a flow chart of an example operational sequence of the automatic accompaniment process.

At step S11, a set of the accompaniment style data selected by user's musical-genre designating operation is loaded from the ROM 2, external storage device 10 or the like and then written, for example, into a predetermined area of the RAM 3. At next step S12, a tone color change is made on the basis of the accompaniment style setting data of the environment setting data stored in the predetermined area of the RAM 3 through execution of the above-described environment-setting-data load process. At that time, even when the environment setting data received from the first automatic accompaniment apparatus has instructed a tone color change for a track having a special-type tone color allocated thereto, the tone color change instruction is recorded as invalid in the environment setting data recorded in the RAM 3, so that, in this case, no tone color change is effected. At following step S13, the automatic performance data of the accompaniment style data are read out at a predetermined tempo, then converted in tone pitch in accordance with designated chords and reproduced with tone colors set (changed) in accordance with the environment setting data recorded in the RAM 3. Namely, when a tone color change from a special-type tone color to an ordinary-type tone color has been instructed for a given track by the environment setting data received from the first automatic performance apparatus, the tone color change is made invalid, so that the instant embodiment can reliably avoid musical failure or nonconformity due to the instructed tone color change and thereby achieve a musically-preferable performance although such a tone color change is not reflected in the performance.

Note that the instant embodiment of the present invention is not limited to the above-described arrangement that the tone-color-change setting information (i.e., tone-color-change presence/absence information, track information plus changed-to-color information) is stored for all of the styles in the accompaniment style setting data included in the environment setting data; instead, such tone-color-change setting information may be stored for only those styles where a tone color change has been instructed. Further, whereas the instant embodiment has been described as storing one tone-color-change presence/absence region and one track/changed-to color region per set of accompaniment style setting data, a region indicative of absence of a tone color change or a changed-to tone color may be stored for each of the tracks, or such information may be stored in any other desired manner.

Also, the accompaniment style setting data may include setting data for any other desired parameter than the tone color, such as the tone volume, effect or the like.

Furthermore, whereas the environment setting data have been described as also including the accompaniment style setting data and other data, the environment setting data may be arranged to include only the accompaniment style setting data. Moreover, the environment setting data and other data may be communicated via a communication interface rather than via an external storage medium. Further, the application of the present invention is not limited to the communication of the environment setting data between two or more automatic performance apparatus, and the present invention can also be applied to a case where the user manipulates predetermined setting operators of an automatic performance apparatus to change the contents of the environment setting data in only one automatic performance apparatus. In such a case, step S1 of FIG. 5 may be changed, for example, to an "operation for changing the contents of the environment setting data and writing the changed environment setting data into a predetermined area of a memory.

It should also be understood that both of the first and second automatic performance apparatus may either store all of similar accompaniment style data corresponding in a one-to-one relation between the two apparatus or store only some of the accompaniment style data. Where accompaniment style data are not stored, similar accompaniment styles may be stored instead. (see Japanese Patent Application Laid-open Publication No. HEI-08-272369). In such a case, the technique of the present invention may be applied to the similar accompaniment styles.

Whereas the preferred embodiment has been described above in relation to the automatic performance apparatus that executes an automatic performance on the basis of the accompaniment style data, the present invention is not so limited and may be constructed as an automatic performance apparatus that executes an automatic performance on the basis of ordinary automatic performance data (e.g., song data).

Further, whereas the preferred embodiment has been described above in relation to the case where different rendition-style-dependent tone colors of a special-type tone color are mapped in both of the velocity and note number directions, different rendition-style-dependent tone colors may be mapped in only one of the velocity and note number directions. Alternatively, the present invention may be applied to any special-type tone colors as long as performance data need to be prepared in accordance with characteristics of the special-type tone colors due to differences from characteristic from ordinary-type tone colors.

Moreover, the application of the present invention is not limited to the case where a tone color change for replacing a special-type tone color with an ordinary-type tone color is made invalid, and the present invention is of course also applicable to a case where a tone color change is made for replacing an ordinary-type tone color with a special-type tone color.

In the case of a tone generator based on the PCM method, it is only necessary that waveform data be prepared per rendition style, in order to provide a tone generator for special-type tone colors; in the case of a tone generator of the FM, physical model, formant method or the like, however, only tone synthesis parameters and algorithm have to be prepared, in order to provide a tone generator for special-type tone colors.

In summary, the present invention is characterized by invalidating a tone color change between special- and ordinary-type tone colors based on a tone color change instruction received from another automatic performance apparatus, with the result that the present invention can reliably avoid musical nonconformity in performed tones that may be undesirably produced with a changed-to new tone color.

What is claimed is:

1. An automatic performance apparatus comprising:

a performance data storage device storing performance data, said performance data including at least a particular type of control parameter and information indicative of a tone color, the tone color being of either a first type for which the particular type of control parameter presents a first variation characteristic or a second type for which the particular type of control parameter presents a second variation characteristic different from said first variation characteristic;

a reception section that receives tone-color-change instructing information; and a performance control device that executes an automatic performance on the basis of the performance data stored in said performance data storage device, said performance control device executing the automatic performance based on the performance data by changing the tone color of the performance data to be automatically performed into a tone color corresponding to the tone-color-change instructing information received by said reception section, wherein said performance control device invalidates a tone color change instruction by the received tone-color-change instructing information, when the received tone-color-change instructing information instructs that the tone color of the performance data to be automatically performed be changed from a tone color of said first type to a tone color of said second type or from a tone color of said second type to a tone color of said first type.

2. An automatic performance apparatus as claimed in claim 1 wherein said particular type of control parameter is velocity data, and wherein, for the tone color of said first type, the velocity data indicates a velocity of a tone color for which only a single domain of values can be taken by the velocity data, but, for the tone color of said second type, the domain of values that can be taken by the velocity data is divided into a plurality of ranges and the velocity data represents a different tone color for each of the ranges and indicates a velocity of the different tone color.

3. An automatic performance apparatus as claimed in claim 2 wherein the different tone colors for individual ones of the ranges in the tone color of said second type belong to a same tone color of a predetermined type and present different tone color characteristics corresponding to different rendition styles.

4. An automatic performance apparatus as claimed in claim 2 wherein, for the tone color of said first type, said particular type of control parameter presents a characteristic to vary a predetermined musical element in a successive manner, but for the tone color of said second type, said particular type of control parameter presents a characteristic to vary a predetermined musical element in an unsuccessive manner.

5. An automatic performance apparatus as claimed in claim 1 where the tone color of said second type comprises a plurality of types of rendition-style-dependent tone colors, corresponding to different rendition styles for a single type of musical instrument, allocated to different values of velocity data or note number data, and wherein said performance control device executes a tone performance while changing, as necessary, a rendition-style-dependent tone color in accordance with velocity data or note number data defined in the automatic performance data corresponding to the tone color of said second type.

6. An automatic performance apparatus as claimed in claim 1 wherein said reception section receives, from outside said automatic performance apparatus, performance environment setting information that includes the tone-color-change instructing information.

7. An automatic performance apparatus as claimed in claim 1 which further comprises a setting section for setting an automatic performance environment, and wherein said reception section receives the tone-color-change instructing information included in the performance environment setting information set via said setting section.

8. A method for executing an automatic performance using a performance data storage device storing performance data, said performance data including at least a particular type of control parameter and information indicative of.a tone color, the tone color being of either a first type for which the particular type of control parameter presents a first variation characteristic or a second type for which the particular type of control parameter presents a second variation characteristic different from said first variation characteristic, said method comprising:

a step of receiving tone-color-change instructing information; and a performance control step of, when an automatic performance is to be executed on the basis of the performance data stored in said performance data storage device, executing the automatic performance based on the performance data by changing the tone color of the performance data to be automatically performed into a tone color corresponding to the tone-color-change instructing information received by said step of receiving, wherein said performance control step includes a step of invalidating a tone color change instruction by the received tone-color-change instructing information, when the received tone-color-change instructing information instructs that the tone color of the performance data to be automatically performed be changed from a tone color of said first type to a tone color of said second type or from a tone color of said second type to a tone color of said first type.

9. A computer readable medium comprising a computer program containing a group of instructions for causing a computer to execute an automatic performance using a performance data storage device storing performance data, said performance data including at least a particular type of control parameter and information indicative of a tone color, the tone color being of either a first type for which the particular type of control parameter presents a first variation characteristic or a second type for which the particular type of control parameter presents a second variation characteristic different from said first variation characteristic, said method comprising:

a step of receiving tone-color-change instructing information; and a performance control step of, when an automatic performance is to be executed on the basis of the performance data stored in said performance data storage device, executing the automatic performance based on the performance data by changing the tone color of the performance data to be automatically performed into a tone color corresponding to the tone-color-change instructing information received by said step of receiving, wherein said performance control step includes a step of invalidating a tone color change instruction by the received tone-color-change instructing information, when the received tone-color-change instructing information instructs that the tone color of the performance data to be automatically performed be changed from a tone color of said first type to a tone color of said second type or from a tone color of said second type to a tone color of said first type.

* * * * *